US005941730A

United States Patent [19]

Uchiyama et al.

[11] Patent Number: 5,941,730

[45] **Date of Patent: *Aug. 24, 1999**

[54] CONNECTOR INSTALLATION STRUCTURE FOR FUEL TANK

[75] Inventors: Takahiro Uchiyama; Shinji Ogawa, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,058

[22] Filed: Nov. 26, 1997

Related U.S. Application Data

[63] Continuation of application No. 08/651,922, May 21, 1996, abandoned.

[30] Foreign Application Priority Data

Jun. 9, 1995 [JP] Japan ..... 7-168140
Jun. 20, 1995 [JP] Japan ..... 7-178219

[51] Int. Cl.[6] ..... H01R 13/74

[52] U.S. Cl. ..... 439/550; 439/565

[58] Field of Search ..... 439/544, 550, 439/565

[56] References Cited

U.S. PATENT DOCUMENTS 2,677,811 5/1954 Anderson et al. .
2,869,094 1/1959 Francis ..... 439/550
4,179,179 12/1979 Lowden ..... 439/550
5,066,247 11/1991 Watson ..... 439/550
5,607,324 3/1997 Saur et al. ..... 439/565

FOREIGN PATENT DOCUMENTS 0224323 6/1987 European Pat. Off. .
9002341 5/1990 Germany .
63211577 9/1988 Japan .

*Primary Examiner*—Gary F. Paumen
*Attorney, Agent, or Firm*—Jordan B. Bierman; Bierman, Muserlian and Lucas

[57] ABSTRACT

An installation structure can carry out a work of attaching a connector (1) to a fuel tank with one touch without using a particular equipment or requiring a great space. A holding sleeve (24) is secured to a lid plate (22) of the fuel tank with the sleeve projecting into an interior of the tank. The holding sleeve (24) is provided in its opposite outer peripheral positions with each of a pair of windows (30). An elastic clip (29) having a substantially U-shaped configuration is mounted on the holding sleeve (24) with each leg (33) of the clip (29) projecting into an interior of the sleeve (24) through each window (30). An inner connection portion (5) of the connector (1) is provided in its opposite outer peripheral position with each of a pair of engaging grooves (36). The portion (5) is also provided in its outer surface below each engaging groove (36) with an inclined guide face (38). When the portion (5) of the connector (1) is being inserted into the holding sleeve (24), the legs (33) are deflected outwardly by the guide faces (38). When the portion (5) is completely inserted in the sleeve (24), the legs (33) fit in the respective grooves (36) by their elastic recovery forces, thereby preventing the connector (1) from coming out of the lid plate (22).

6 Claims, 10 Drawing Sheets

CONNECTOR INSTALLATION STRUCTURE FOR FUEL TANK

This application is a continuation, of application Ser. No. 08/651,922, filed May 21, 1996, now abandoned.

BACKGROUND OF THE INVENTION (1) Field of the Invention

This invention relates to a connector installation structure for a fuel tank which is attached to a wall of a fuel tank for an automobile or the like and is used to connector electrical devices in the tank to an external power source.

(2) Statement of the Prior Art

Heretofore, a connector installation structure for a fuel tank is known from, for example, Japanese Patent Public Disclosure No. SHO 63-211577 (1988). For convenience of explanation, a conventional connector installation structure will be described below by referring to FIG. 16. FIG. 16 is a longitudinal sectional view of the conventional connector installation structure.

A connector 1 is formed to have a substantially L-shaped configuration and is provided on its opposite ends with male connection portions 52 and 53 adapted to be coupled to mating female connectors C2 and C3, respectively. On the other hand, a lid plate 54 of a fuel tank (not shown) is provided with an attaching hole 55 through which a sleeve 56 is secured by means of soldering. The inner connection portion 52 of the connector 51 is fitted in the sleeve 56 through a seal ring 57 in a water-tight manner. The connector 51 is secured to the lid plate 54 by caulking tongues 58 provided on a lower end of the sleeve 56 onto an engaging stepped portion 59 in the outer periphery of the connector 51.

However, the conventional connector installation structure requires additional equipment for caulking and thus entails additional costs for such equipment. It is also necessary to provide a space for receiving a caulking tool inside the lid plate 54. It will be difficult, however, to define such a space in the fuel tank due to space constraints and the existence of devices such as a fuel supply pump and pipes, a fuel gauge, and the like around the caulking space. Caulking work also increases steps in the attaching process.

SUMMARY OF THE INVENTION

An object of the present invention is to provide a connector installation structure for a fuel tank which requires no particular equipment and space for an attaching process.

In order to achieve the above object, in a connector installation structure for a fuel tank in accordance with the present invention, a holding sleeve for receiving a connector for the fuel tank is fixed through a cover plate adapted to be mounted on a wall of the fuel tank and the connector can be prevented from coming out of the cover plate by elastically fitting a clip on the connector so as to engage with the holding sleeve. The connector comprises: a plug body adapted to be fitted in the holding sleeve; an inner connection portion having a smaller diameter than the plug body and adapted to be contained in the fuel tank; and an outer connection portion projecting outwardly from the fuel tank. Consequently, the clip is elastically fitted to an outer periphery of the inner connection portion so as to engage with the holding sleeve.

The holding sleeve may be provided in the intermediate portion with opposite windows. The clip has a pair of flexible legs. The clip is detachably mounted on the holding sleeve so that each of the legs moves into and away from the interior of the holding sleeve through each of the windows. Each leg enters a lock hole in the connector through each window when the connector is inserted in the holding sleeve, thereby preventing the connector from coming out of the holding sleeve.

The inner connection portion may be exposed from the holding sleeve at the distal end when the inner connection portion is inserted into the holding sleeve. The clip is mounted on the exposed end of the inner connection portion so that the clip engages with the holding sleeve, thereby preventing the connector from coming out of the holding sleeve.

After the connector is fitted in the holding sleeve, the clip is elastically mounted on the connector. Thus, the connector cannot come out of the holding sleeve since the clip is mounted on the holding sleeve.

On the other hand, the clip may be mounted in the windows in the holding sleeve, before the connector is fitted in the holding sleeve. Then, the legs of the clip project inwardly in the interior of the holding sleeve through the windows. When the connector is fitted in the holding sleeve, the legs are deflected outwardly to permit the connector to pass therethrough. When the connector is fitted in the lock hole, the connector is held in the holding sleeve not to come out of the sleeve.

When the connector is fitted in the holding sleeve, the lower end of the connector is exposed from the lower end of the holding sleeve. Thereafter, if the clip is mounted on the exposed portion of the connector, the clip engages with the holding sleeve so as to prevent the connector from coming out of the sleeve.

According to the present invention, since the clip is elastically mounted on the connector to secure it to the sleeve, a particular equipment is not required in connection with the conventional caulking manner. Consequently, it is possible to reduce a cost and a great space for an equipment, thereby increasing a flexibility of arrangement of devices in the tank and realizing a compact size of the fuel tank.

Also, if the clip is mounted on the holding sleeve before the connector is fitted in the holding sleeve, it will be possible to enhance an efficiency of the attaching work since the connector can be secured to the sleeve merely by inserting the connector into the sleeve.

It will be also possible to achieve the same effect described above since the clip can fix the connector by means of an elastic force.

Another object of the present invention is to provide a connector installation structure for a fuel tank which can facilitate an attaching work of the connector and prevent the clip from coming out of the connector.

In order to achieve the above object, in a connector installation structure for a fuel tank, a holding sleeve for receiving a connector for the fuel tank is fixed through a cover plate adapted to be mounted on a wall of the fuel tank and the connector can be prevented from coming out of the cover plate by elastically fitting a clip on the connector so as to engage with the holding sleeve. The clip has a pair of legs which can widen to elastically embrace the connector on the outer surface. Each of the legs is provided on the distal end with a pawl which is adapted to engage with an engaging part on the outer surface of the inner connection portion of the connector while the pawls prevent the legs from widening.

Also, in the above installation structure, the clip includes a base piece and a pair of leg pieces each of which extends from each of the opposite ends of the base piece so that leg pieces elastically embrace the inner connection portion on the outer surface and each pawl on the distal end of each leg piece engages with the engaging part on the inner connection portion in the manner of limiting an outward deflection of the leg pieces. The base piece is pushed on the outer surface opposite the engaging part by means of an elastic force so that the pawls press the engaging part.

According to the present invention, the clip is elastically mounted on the connector fitted in the holding sleeve. In this case, the clip is mounted while widening both legs. When the clip is completely mounted on the connector, the clip also engages with the holding sleeve, thereby preventing the connector from coming out of the sleeve. In the final mounting position of the clip, the pawls of the clip engage with the engaging parts on the connector so that both legs cannot be widened. This prevents the clip from slipping out of the connector.

According to the present invention, when the clip is mounted on the connector, the pawls of the legs engage with the engaging parts on the connector. On the other hand, the base piece of the clip is elastically pushed onto the connector at the opposite side of the engaging parts. The elastic force exerted in the base piece causes the pawls to bite the engaging parts, thereby enhancing the engaging force of the clip.

The present invention does not require a particular equipment which was necessary in the prior caulking manner, because the mounting of the clip finishes the attaching process of the connector. The clip is restrained from coming out of the connector accidentally, thereby enhancing reliability of the clip, because the pawls of the clip engage with the engaging parts on the connector to inhibit widening the legs of the clip.

The base piece is pressed on the connector with an elastic force. Since the elastic force causes the pawls to bite the engaging parts, the clip can increase the mounting force and ensure the attachment of the connector.

DETAILED DESCRIPTION OF THE PREFERRED EMBODIMENTS

Embodiments of a connector installation structure for a fuel tank in accordance with the present invention will be described below by referring to FIGS. 1 to 15.

FIRST EMBODIMENT

A first embodiment of a connector structure for a fuel tank will be now explained by referring to FIGS. 1 to 8.

Figure 1:
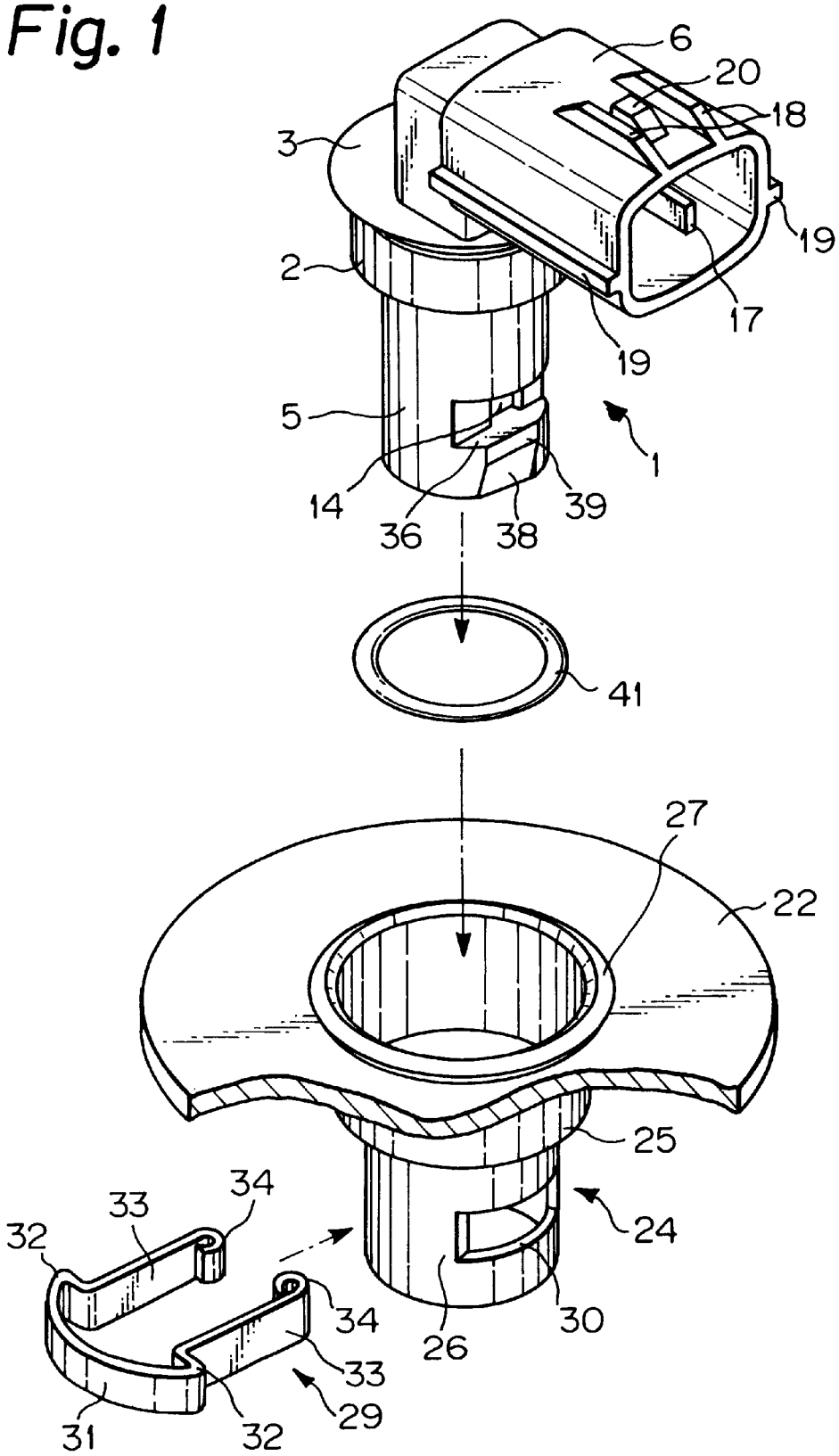
FIG. 1 is an exploded perspective view of a first embodiment of a connector installation structure for a fuel tank in accordance with the present invention.
Figure 2:
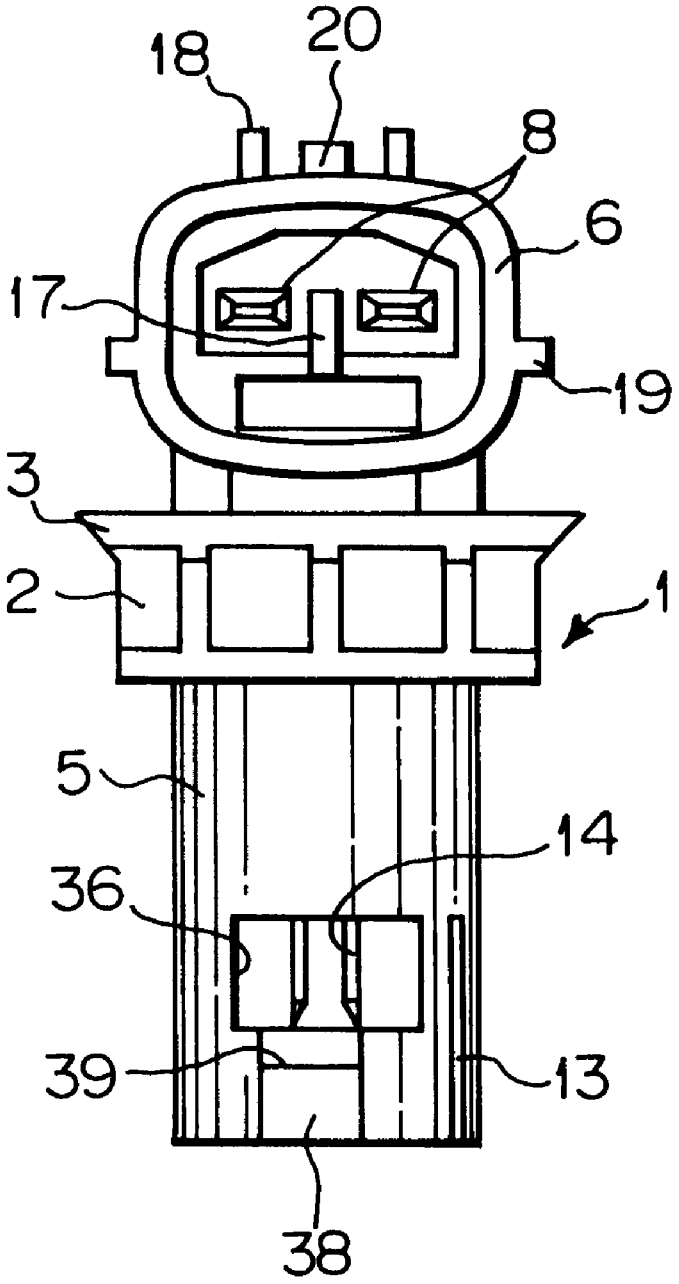
FIG. 2 is a front elevational view of a connector for the fuel tank.
Figure 3:
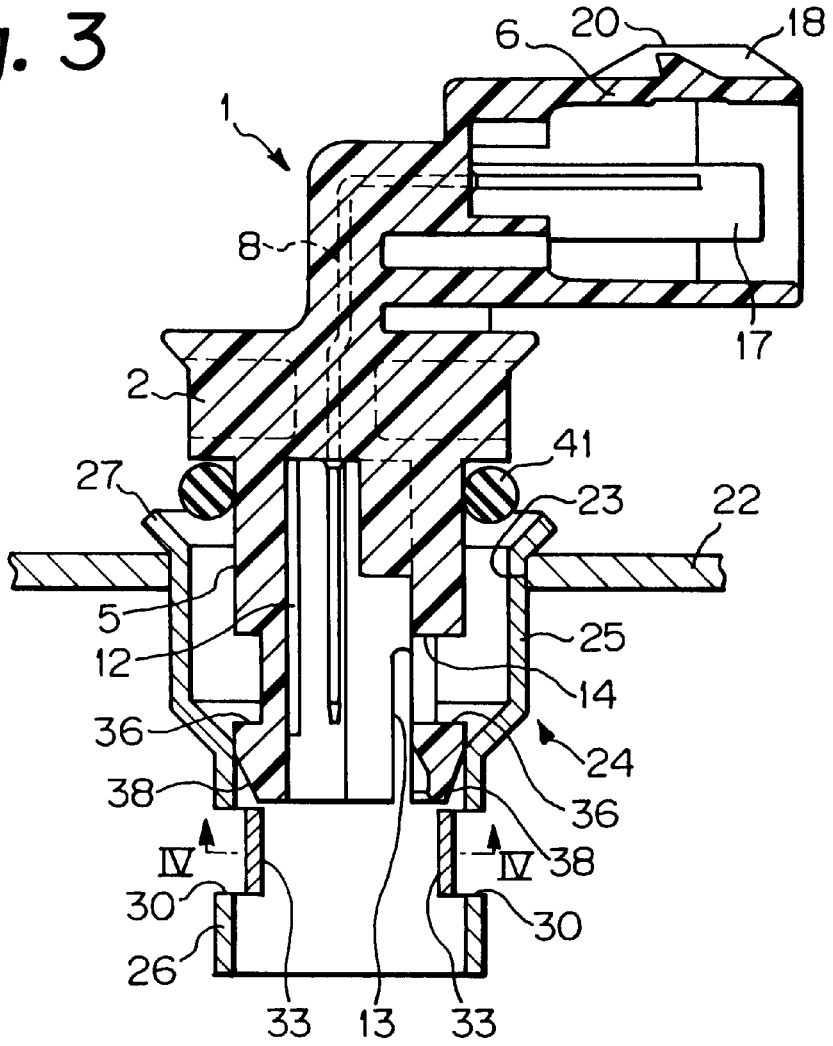
FIG. 3 is a longitudinal sectional view of the connector installation structure in which the connector is in an initial step in an installing operation.

In FIG. 1, a connector 1 for a fuel tank (not shown) is made of a synthetic resin material and formed into a substantially U-shaped configuration. The connector 1 is provided on a middle section with a thick disc-like plug body 2 having a tapered flange 3 at the upper end, on a lower section under the plug body 2 with a cylindrical inner connection portion 5 having a smaller diameter than the plug body, and on an upper section above the plug body with a box-like outer connection portion 6 which is disposed in perpendicular to the longitudinal axis of the plug body 2. The inner connection portion 5 receives a female connector 10 (shown by two-dot chain lines in FIG. 7) which is connected to electrical devices in the fuel tank, while the outer connection portion 6 receives another female connector 16 (shown by two-dot chain lines in FIG. 7) which is connected to an external power source (not shown). As shown in FIG. 3, a pair of L-shaped male terminal pins 8 are embedded in the connector 1 by an insert molding process with the opposite ends projecting into the respective interiors in the inner and outer connection portions 5 and 6.

The inner connection portion 5 of the connector 1 is provided in the interior with a guide 12 extending longitudinally in the inner periphery, a slit 13 which is open at the lower end edge of the connector 1 and extends longitudinally and a lock hole 14 which is open at the inner periphery. When the mating female connector 10 which is provided on the outer periphery with a lock projection (not shown) is inserted into the inner connection portion 5 through the guide 12 and slit 13, the portion 5 is enlarged in a radial direction. When the lock projection is fitted in the lock hole 14, the connectors 1 and 10 are interlocked.

The outer connection portion 6 is provided in the interior with a partition wall 17 between the terminal pins 8, guides 18 and 19 extending longitudinally on the top and side surfaces, and a lock projection 20 between the guides 18 on the top surface. When the mating female connector 16 is coupled to the outer connection portion 6 through the partition wall 17, and guides 18, 19 and a lock hole (not shown) in the female connector 16 receives the lock projection 20, the connectors 1 and 16 are interlocked.

Next, a structure in which the connector for the fuel tank is installed on the fuel tank will be explained below.

In FIGS. 1 and 3, a lid plate 22 adapted to be mounted on the top of the fuel tank is provided with an attaching mouth 23 through which a holding sleeve 24 is fixed. The holding sleeve 24 is formed into a stepped cylinder so that it includes a large diametric portion 25 adapted to be closely fitted in the attaching mouth 23 and a small diametric portion 26 under the portion 25. The large diametric portion 25 is provided on the upper end with an upwardly flared inlet 27.

Figure 7:
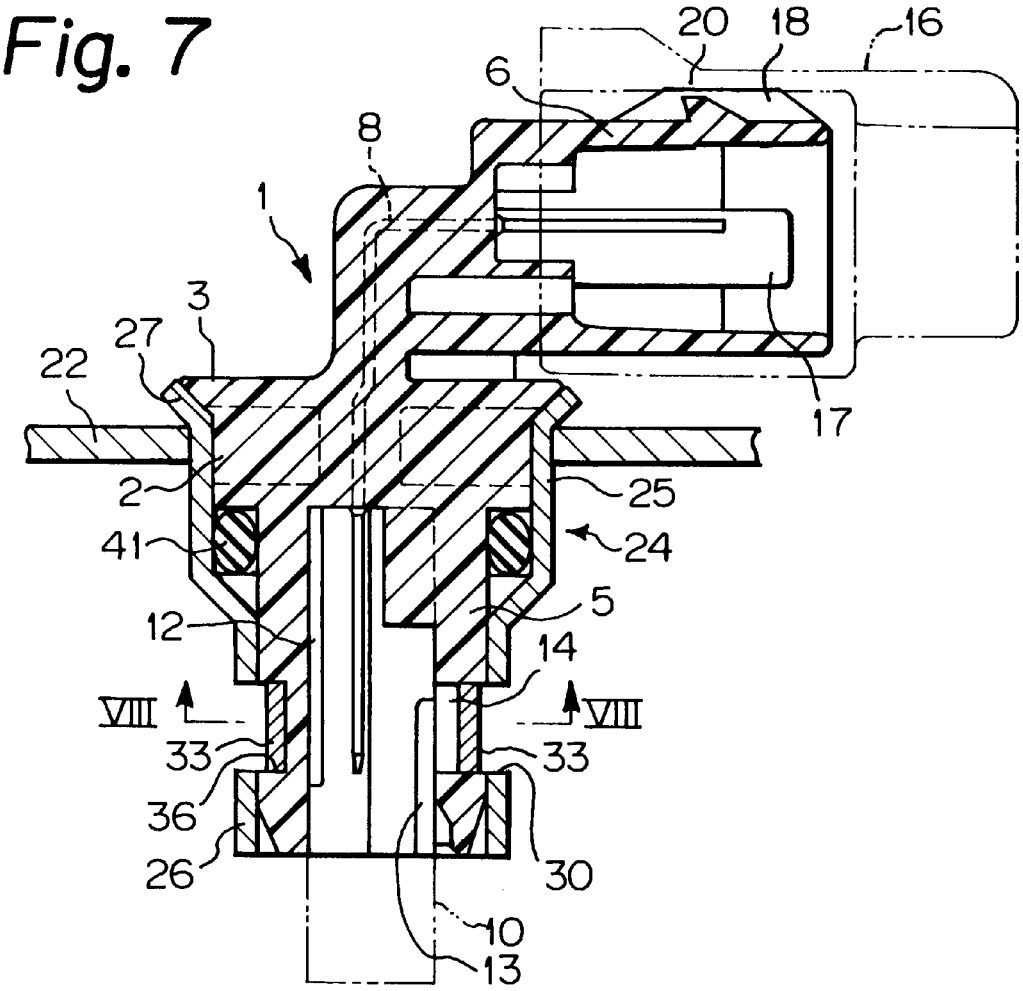
FIG. 7 is a longitudinal sectional view of the connector installation structure in which the connector is in a final step in the installing operation.

The plug body 2 of the connector 1 is closely fitted in the inlet 27 and an upper half part of the large diametric portion 25 (see FIG. 7). The holding sleeve 24 is inserted into the attaching mouth 23 from the upper side on the lid plate 22 and the inlet 27 abuts on the edge of the attaching mouth 23. The holding sleeve 24 is secured to the lid plate 22 with the lower end of the sleeve projecting downwardly in the fuel tank by soldering the inlet 27 around the mouth 23.

A clip 29 is mounted on the small diametric portion 26 of the holding sleeve 24 for locking the connector 1 in the sleeve 24. The small diametric portion 26 of the holding sleeve 24 is provided in the opposite sides on the outer periphery with each of a pair of windows 30 which extend in a direction perpendicular to the axial direction. On the other hand, the clip 29 is formed into a generally U-shaped configuration having an arcuate base portion 31, a pair of flexible legs 33 each of which extends from each of the opposite ends of the base portion 31 through a bent portion 32 in parallel with the other leg, and a pair of hook portions 34 each of which is formed by turning the distal end of each leg inwardly.

Figure 4:
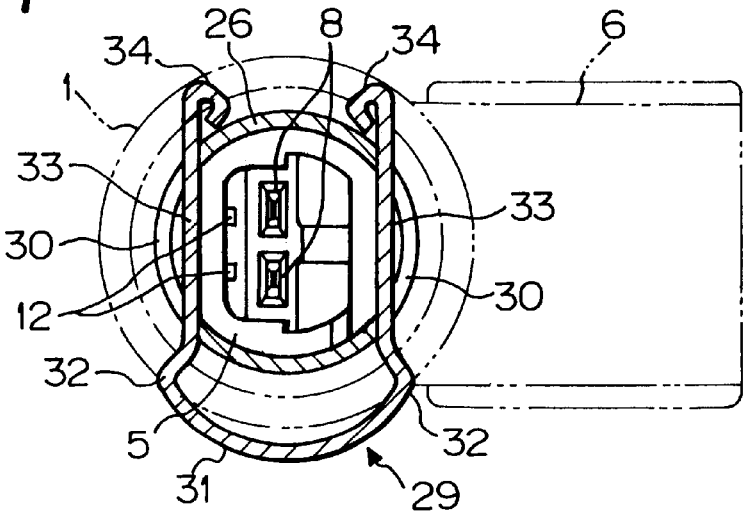
FIG. 4 is a cross sectional view of the structure taken along line IV—IV in FIG. 3.
Figure 5:
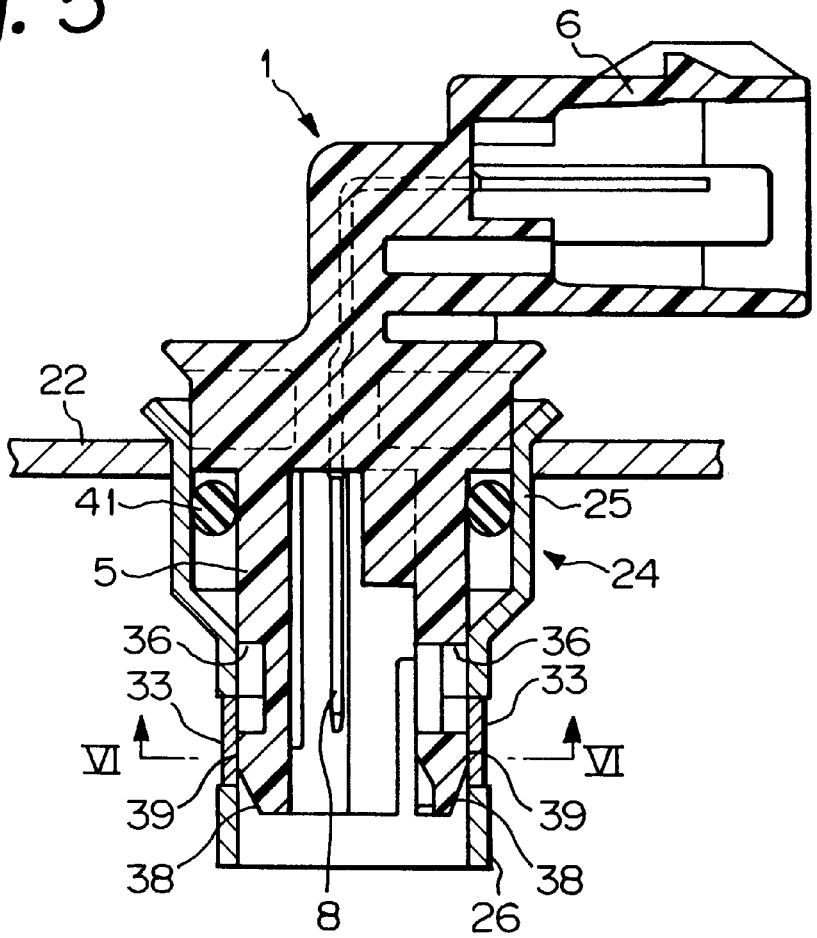
FIG. 5 is a longitudinal sectional view of the connector installation structure in which the connector is in an intermediate step in the installing operation.
Figure 6:
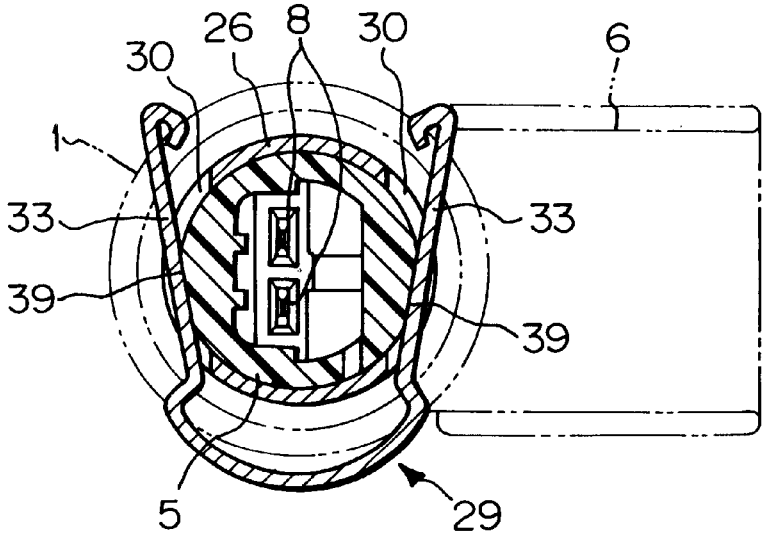
FIG. 6 is a cross sectional view of the structure taken along line VI—VI in FIG. 5.

When each leg 33 of the clip 29 is inserted into each window 30 from the one end thereof while being deformed outwardly against the elasticity of the leg and when the hook portion 34 of the leg 33 slides over the other end of the window 30 while being deformed outwardly again, both legs 33 close inwardly by their elastic recovery forces, so that the hook portions engage with the opposite outer periphery of the small diametric portion 26, thereby preventing the clip 29 from coming out of the holding sleeve 24. Then, as shown in FIG. 4, both legs 33 of the clip 29 project into the interior of the small diametric portion 26 of the holding sleeve 24 through the window 30.

The inner connection portion 5 of the connector 1 is provided in the outer peripheral surface with a pair of opposite engaging grooves 36 which are adapted to receive the legs 33 of the clip 29 which project in the interior of the holding sleeve 24 through the windows 30. The engaging grooves 36 are disposed in the inner connection portion 5 to align with the windows 30 in the holding sleeve 24 when the inner connection portion 5 and plug body 2 of the connector 1 are completely inserted in the holding sleeve 24. One of the engaging grooves 36 is provided in the bottom wall with the lock hole 14 adapted to receive the lock projection of the female connector 10 in the fuel tank.

The inner connection portion 5 is provided below the engaging grooves 36 in the outer peripheral surface with a pair of tapered guide faces 38 having a given width and a gradually reducing thickness. A flat face 39 is provided between the upper edge of the guide face 38 and the lower edge of the engaging groove 36, as shown in FIG. 1.

An O-ring 41 is provided between the inner peripheral face on the large diametric portion 25 of the holding sleeve 24 and the outer peripheral face on the inner connection portion 5 of the connector 1.

Next, an attaching process of the installation structure in the above embodiment will be explained below.

As described above, the clip 29 is mounted on the holding sleeve 24 with both legs 33 being closed to project into the holding sleeve 24 through the window 30. On the other hand, the O-ring 41 is fitted on an upper end of the outer periphery of the inner connection portion 5 in the connector. The female connector 10 connected to the electrical devices in the fuel tank is drawn through the holding sleeve 24 above the lid plate 22 and fitted in the inner connection portion 5 beforehand. At this time, the lid plate 22 may be either predeterminately or not yet secured to the fuel tank.

As shown in FIGS. 3 and 4, the inner connection portion 5 of the connector 1 for the fuel tank is inserted into the holding sleeve through the upper end side after the engaging grooves 36 in the outer periphery of the portion 5 is aligned with the windows 30 in the holding sleeve 24.

When the connector 1 is pushed into the holding sleeve 24, the inclined guide faces 38 on the lower end of the inner connection portion 5 abut on the upper edges on the legs 33 of the clip 29 which project into the holding sleeve 24. As the connector 1 moves forwardly in the holding sleeve 24, the legs 33 slide over the guide faces 38 while increasing a distance between the legs and the distance becomes maximum when the legs reach the flat surface 39. At this time, the O-ring 41 is fitted on the large diametric portion 25 of the holding sleeve 24 while being compressed.

Figure 8:
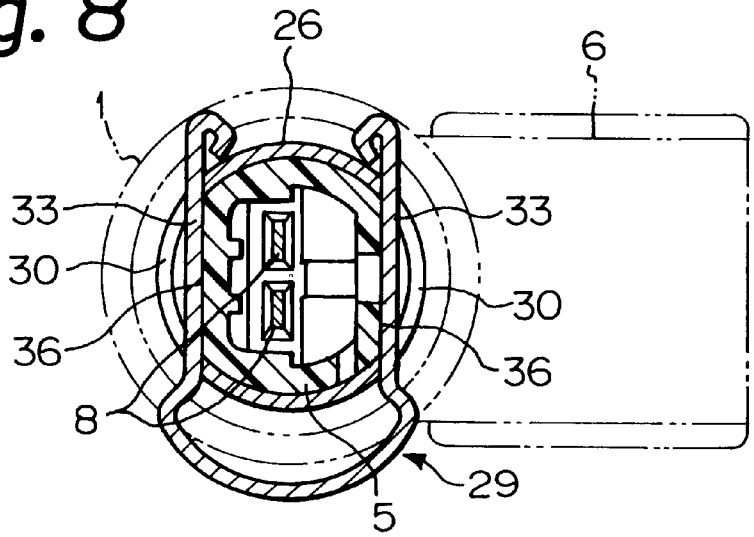
FIG. 8 is a cross sectional view of the structure taken along line VIII—VIII in FIG. 7.

When the connector 1 is further pushed into the holding sleeve 24 so that the flange 3 of the plug body 3 comes into contact with the engaging part 27, as shown in FIGS. 7 and 8, the engaging grooves 36 in the inner connection portion 5 are opposed to the windows 30 in the holding sleeve 24. Then, the legs 33 of the clip 29 enter the engaging grooves 36 by their elastic recovery forces, thereby restricting the connector from coming out of the holding sleeve 24. The O-ring 41 is mounted in a space between the large diametric portion 25 of the holding sleeve 24 and the inner connection portion 5 of the connector 1 under a compressed state, thereby achieving a water-seal between the holding sleeve 24 and the connector 1.

Finally, the female connector 16 drawn from the external power source is coupled to the outer connection portion 6 of the connector 1. If the lid plate 22 is not yet secured to the fuel tank, fixing steps of the lid plate 22 and the holding sleeve 24 are carried out.

According to the first embodiment, it is possible to install the connector 1 in the holding sleeve 24 to be secured to the lid plate 22 by an one-touch work and to enhance an efficiency of an attaching work of the connector 1. Since the present invention does not require equipment used for a conventional caulking type connector, it is also possible to reduce (equipment and production) costs. No particular space for attaching the connector in the fuel tank is required, flexibility in arrangement of various devices such as a pump, pipes, a fuel gauge, and the like in the fuel tank is enhanced, and the fuel tank can be formed to have a compact size.

SECOND EMBODIMENT

Figure 9:
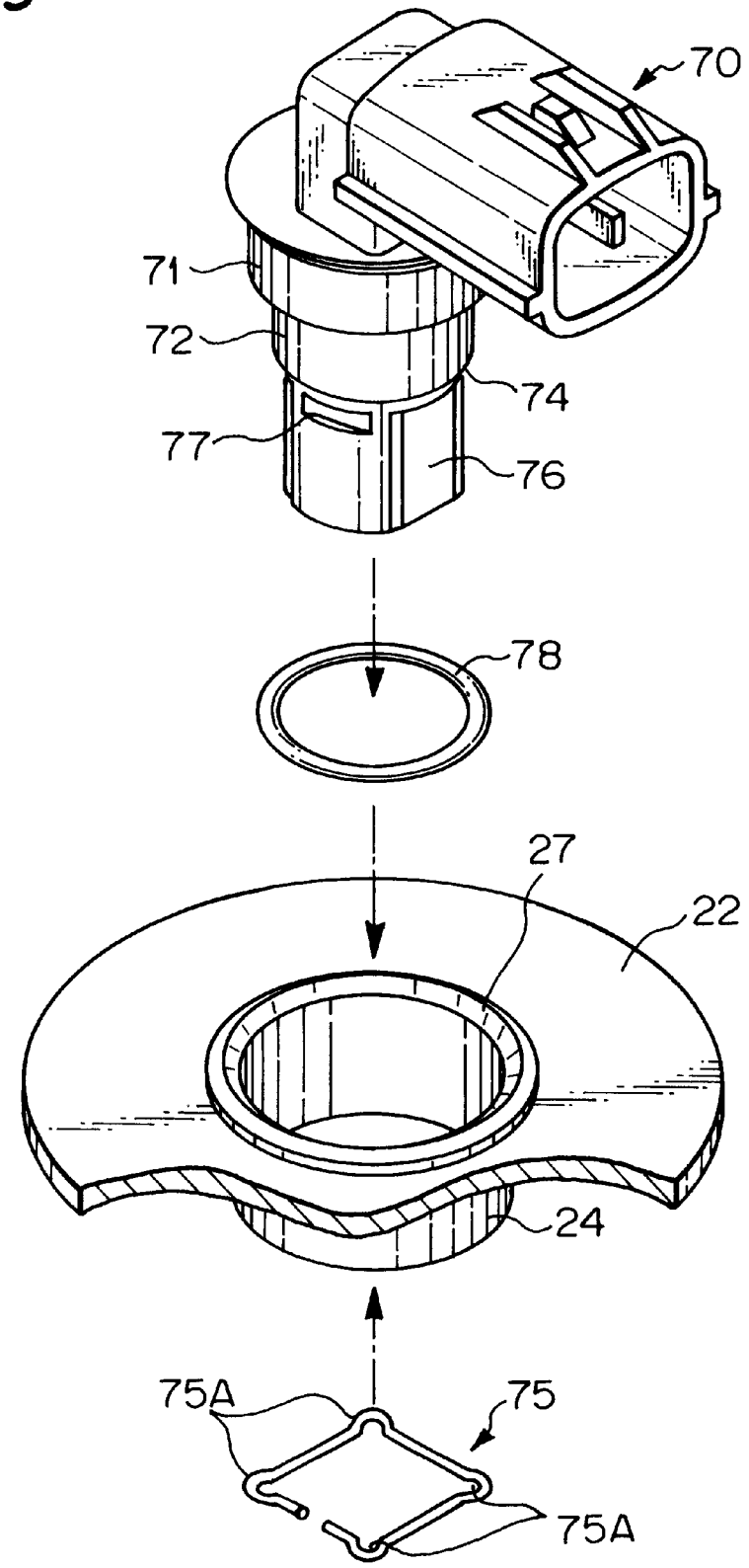
FIG. 9 is an exploded perspective view of a second embodiment of a connector installation structure in accordance with the present invention.
Figure 10:
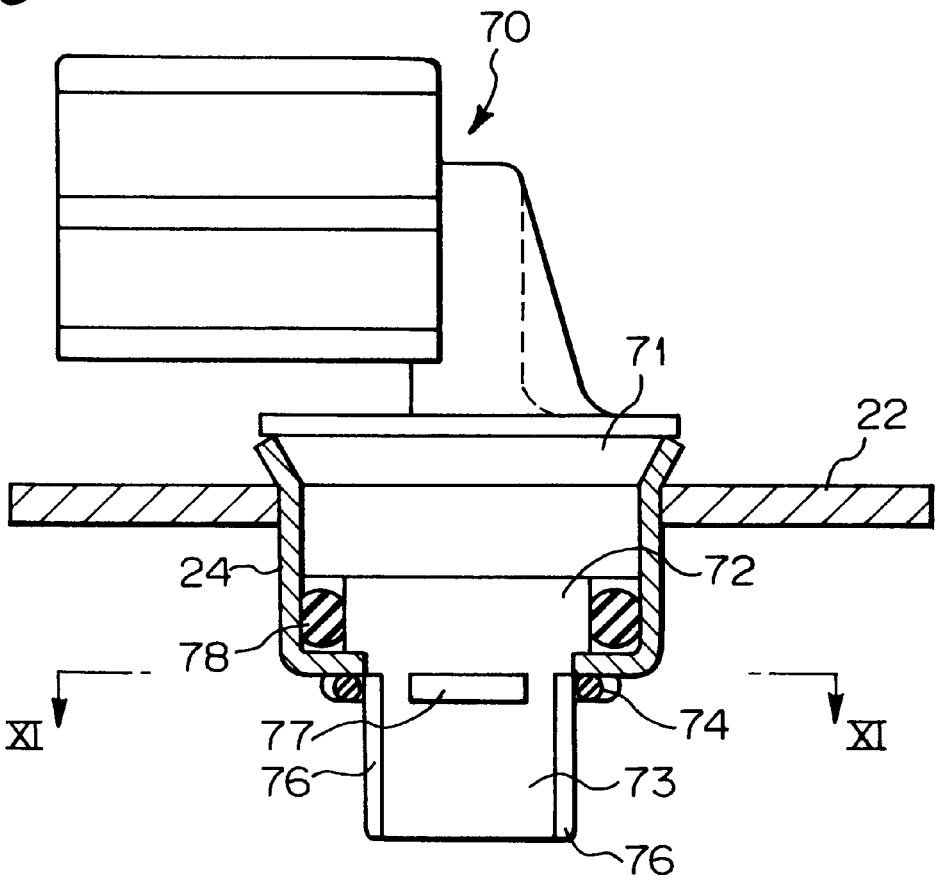
FIG. 10 is a fragmentary longitudinal sectional view of the installation structure in the second embodiment, illustrating the connector in a final step in an installing operation.
Figure 11:
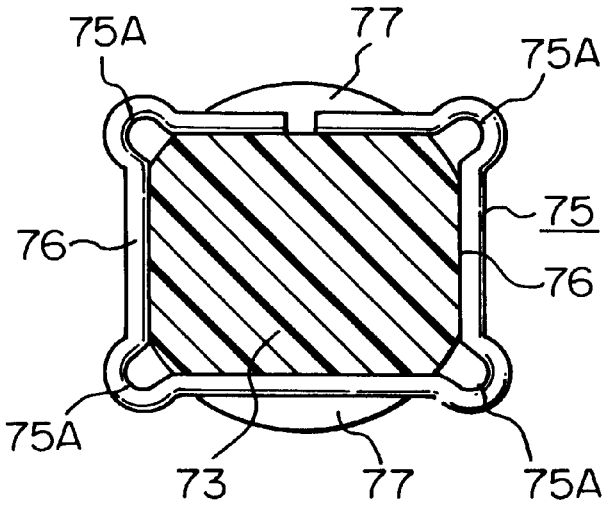
FIG. 11 is a cross sectional view of the structure taken along line XI—XI in FIG. 10.

FIGS. 9 to 11 show a second embodiment of a connector installation structure for a fuel tank in accordance with the present invention. A holding sleeve 24 in the second embodiment is slightly shorter than that in the first embodiment. The holding sleeve 24 is open at the upper and lower ends and the bottom surface of the sleeve 24 is substantially perpendicular to the cylindrical side surface.

On the other hand, a connector 70 includes a plug body 71, a relay shaft portion 72 under the body 71, and an inner connection portion 73 extending coaxially under the portion 72. A shoulder 74 is provided between the relay shaft portion 72 and the inner connection portion 73 to be born on the bottom surface of the holding sleeve 24, thereby exposing the whole inner connection portion 73 from the lower end of the holding sleeve 24.

The inner connection portion 73 is provided on lower opposite end sides with each of a pair of flat mounting surfaces 76 and with each of a pair of engaging grooves 77 which are disposed in perpendicular to the mounting surfaces 76. The engaging grooves 77 are disposed on the outer peripheral surface of the inner connection portion 73 so that the grooves 77 are exposed from the lower end of the holding sleeve 24. The holding sleeve 24 has a substantially rectangular shape in cross section except four corners, which is defined by the grooves 77 and mounting surfaces 76, as shown in FIG. 11. Such a rectangular shape is suitable for mounting a clip 75 described below.

The clip 75 is formed into a substantially rectangular shape by bending a metal wire. The clip 75 is provided at the four corners with an expanded portion 75A which assists opposite free ends in widening. That is, the clip 75 under a normal condition is smaller than the inner connection portion 73 and the clip 75 is forced to be widened at its free ends when it is mounted on the portion 73 from the lower end. When the clip 75 reaches on the mounting faces 76 and engaging grooves 77, the clip 75 engages with them by its elastic recovery force. Then, the clip 75 engages with the lower end face of the holding sleeve 24, thereby restraining the connector 70 from coming out of the holding sleeve 24.

In the second embodiment constructed above, the connector 70 is inserted into the holding sleeve 24 through the O-ring 78. The shoulder 74 of the connector 70 engages with the bottom surface of the holding sleeve 24 and the lower end of the inner connection portion 73 is exposed from the sleeve 24. Thereafter, the clip 75 is pushed onto the inner connection portion 73 from its lower end. The clip 75 is slid upwardly on the portion 73 while being widened. The expanded portions 75A at the four corners of the clip 75 can assist the clip to be smoothly widened. When the clip 75 is fitted on the mounting faces 76 and in the engaging grooves 77, the clip 75 narrows itself by means of its elastic recovery force to be locked on them. When the clip 75 is locked on the inner connection portion 73, the clip 75 engages with the lower end surfaces of the holding sleeve 24, thereby preventing the connector from sliding out of the sleeve 24. The other working steps are the same as those of the first embodiment.

According to the second embodiment of the present invention, it is possible to make the attaching processes simpler and more efficient similarly to the first embodiment and to obviate the need for equipment used in the prior art.

The other structures and effects in the second embodiment are the same as those in the first embodiment.

THIRD EMBODIMENT

Referring now to FIGS. 12 to 15, a third embodiment of a connector installation structure for a fuel tank in accordance with the present invention will be explained below.

Figure 12:
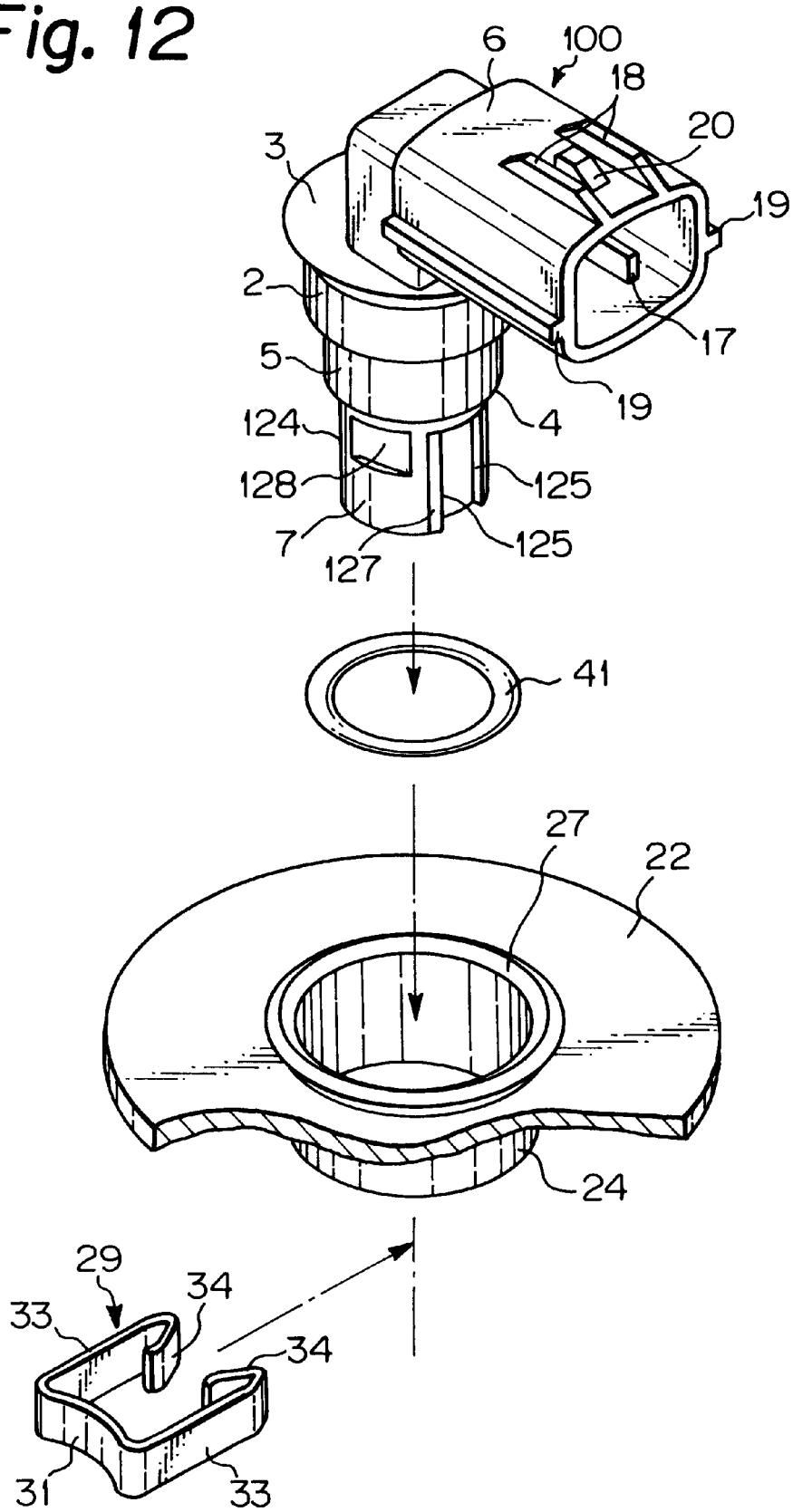
FIG. 12 is an exploded perspective view of a third embodiment of a connector installation structure in accordance with the present invention.

In FIG. 12, a connector 100 for a fuel tank (not shown) is made of a synthetic resin and formed to have a substantially L-shaped configuration. The connector 100 is provided with a plug body 2 having a tapered thick disc-like flange 3, a relay shaft portion 5 having a smaller diameter than the plug body 2 and connected to the lower end of the body 2, and an inner connection portion 7 having a smaller diameter than the portion 5 and connected through a shoulder 4 to the lower end of the portion 5. On the other hand, the connector 100 is also provided above the plug body 2 with a box-like outer connection portion 6 which is directed in perpendicular to the axis of the plug body.

The inner connection portion 7 is coupled to a female connector (not shown) connected to electrical devices in the fuel tank while the outer connection portion 6 is coupled to another female connector (not shown) connected to an external power source. A pair of L-shaped male terminal pins (not shown) similar to the connector 100 are embedded in the connector 100 by means of an insert molding process. The opposite ends of the pins project into the interiors in the inner and outer connection portions 7 and 6.

The outer connection portion 6 includes a partition piece 17 between the male terminal pins, guides 18 and 19 on the top and side surfaces thereof, and a lock protrusion 20 between the top guides 18, 18. The mating female connector is mounted on the outer connection portion 6 along the partition 17 and guides 18, 19. When a lock hole (not shown) in the female connector receives the lock protrusion 20 on the portion 6, both connectors are interlocked.

A construction in which the connector 100 is attached to the fuel tank will be explained below.

Figure 13:
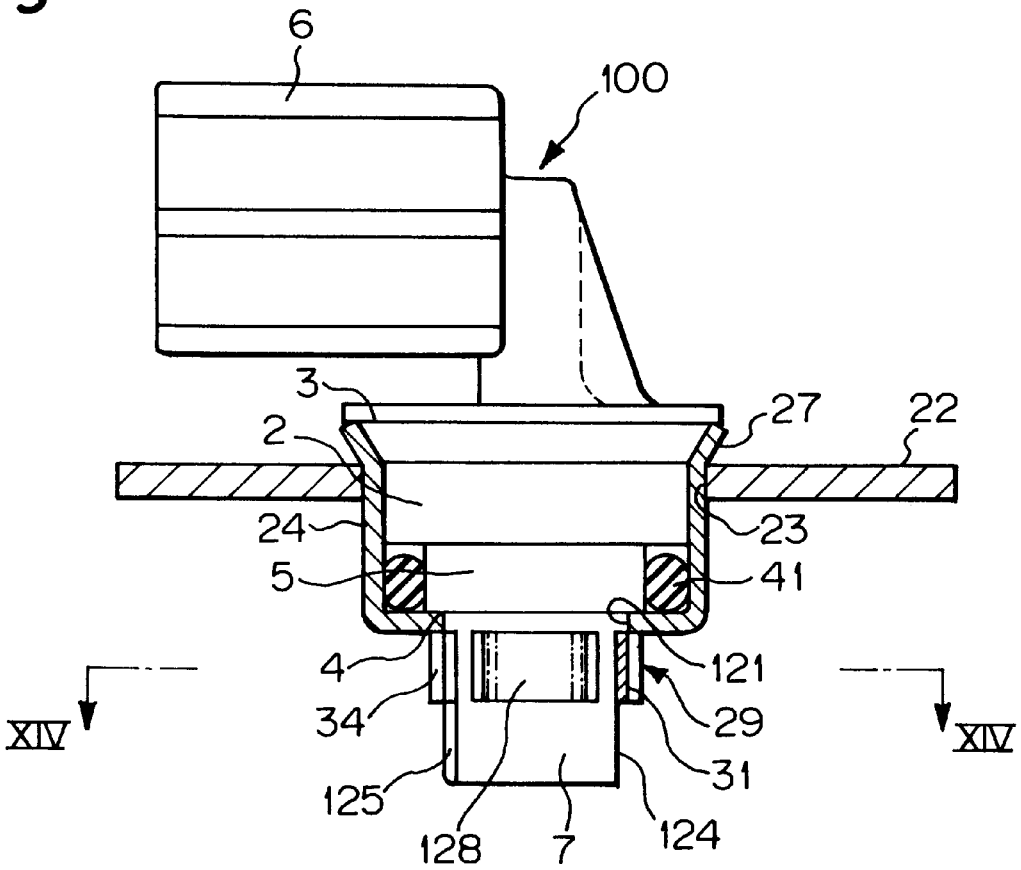
FIG. 13 is a fragmentary longitudinal sectional view of the installation structure in the third embodiment, illustrating the connector in a final step in an installing operation.
Figure 14:
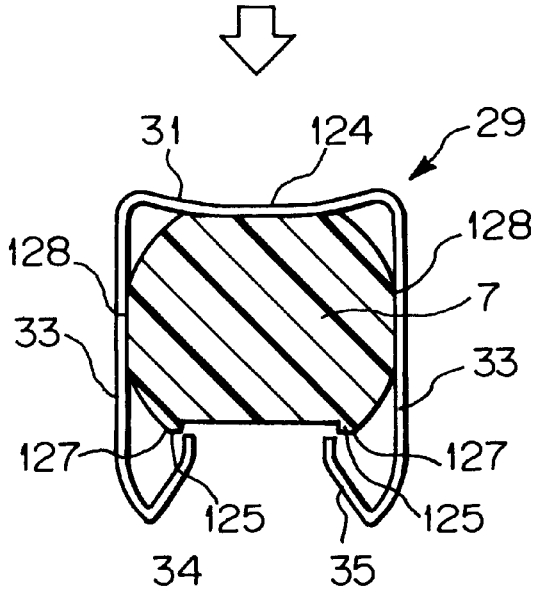
FIG. 14 is a cross sectional view of the structure taken along line XIV—XIV in FIG. 13, illustrating a state in which hooked tips of a clip are released from the connector by manually pushing a base portion of the clip.
Figure 15:
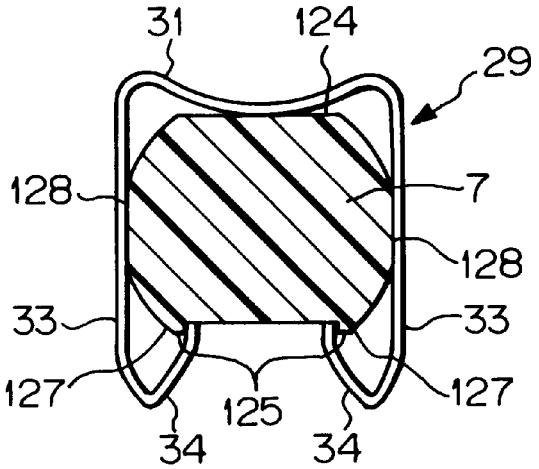
FIG. 15 is a similar view to FIG. 14, illustrating a state in which the hooked tips engage with the connector.
Figure 16:
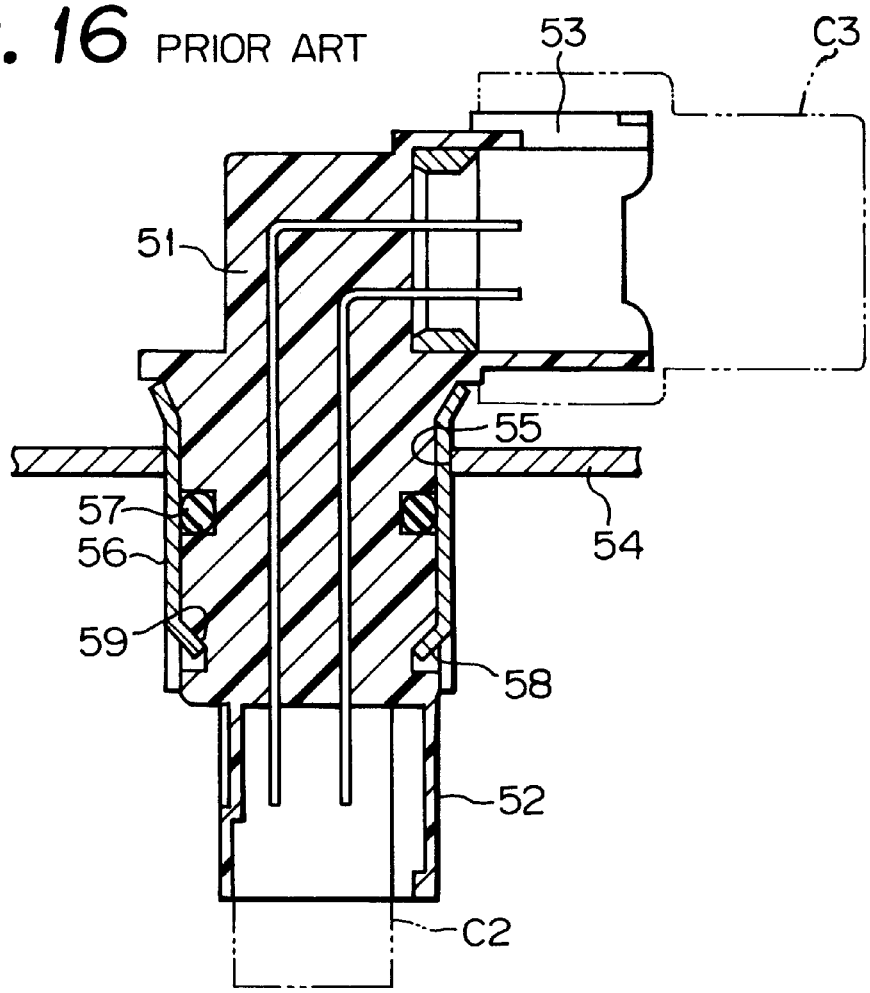
Fig. 16 PRIOR ART
FIG. 16 is a longitudinal sectional view of a conventional connector installation structure for a fuel tank.

In FIGS. 12 and 13, a lid plate 22 to be mounted on an upper wall of the fuel tank has an attaching hole 23 through which a holding sleeve 24 is secured. The holding sleeve 24 is inserted into the attaching hole 23 from its upper side. A stopper portion 27 is mounted and soldered around the attaching hole 23 so that the holding sleeve projects its lower end downwardly in the fuel tank.

The holding sleeve 24 is formed to have a cylindrical shape adapted to be closely fitted in the attaching hole 23 in the lid plate 22 and to closely hold the plug body 2 directly and the relay shaft portion 5 through the O-ring 41 in the interior in the sleeve 24. The holding sleeve 24 has a bottom wall which is substantially perpendicular to the side wall and is provided in its central part with a through-hole 121. The inner connection portion 7 passes through the through-hole 121 with the shoulder 4 mounting around the through-hole 121.

A clip 29 is mounted on the inner connection portion 7 in order to prevent the connector 100 from coming out of the holding sleeve 24. The inner connection portion 7 is provided on the outer surface with a flat bearing face 124 which extends axially from the lower end of the portion 7 to the shoulder 4. The face 124 is adapted to bear a base piece 31 of the clip 29. The inner connection portion 7 is also provided on a part opposite to the face 124 with a flat recess. The flat recess is provided on opposite side edges with each of a pair of stopper projections 125 which extend axially from the lower end of the portion 7 to the shoulder 4. The stopper projections 125 serve to restrict the clip 29 from widening. The stopper projection 125 is provided on its outer side surfaces with each of a pair of slant guide edges 127 which serves to guide pawls 34 of the clip 29.

In addition, the inner connection portion 7 is provided on the outer periphery with each of a pair of engaging grooves 128 which are perpendicular to the bearing face 124 and stopper projections 125 and have the same height as a width of the clip 29.

The clip 29 is formed to have a substantially U-shaped configuration by bending a thin metal or synthetic resin strip having an elasticity. The clip 29 includes a base piece 31 and a pair of leg pieces 33 each of which extends from each of opposite ends of the base piece 31. The base piece 31 is gradually curved toward the inside of the clip 29. The leg pieces 33 can be elastically deformed outwardly to elastically embrace and clamp the inner connection portion 5 at the engaging grooves 128. Each of the leg pieces 33 is provided on the distal end with a deformable pawl 34 having a V-shaped configuration which is directed inwardly and adapted to engage with a stopper projection 125. The base piece 31 has a smaller radius of curvature than that under the normal state thereof when the base piece 31 is pressed on the inner connection portion 5 at the center part so that the pawls 34 engage with the stopper projections 125, respectively.

Next, an operational effect of the third embodiment constructed above will be explained below. First, the lid plate 22 is removed from the fuel tank and the O-ring 41 is mounted on the relay shaft portion 5. Then, the connector 100 is inserted into the holding sleeve 24 from its top end. Thus, the connector 100 is fitted in the holding sleeve 24 in a sealed manner with the inner connection portion 7 being exposed from the holding sleeve 24. The clip 29 is mounted on the inner connection portion 7 from the side of the bearing face 124 while the pawls 34 of the clip 29 slide in the engaging grooves 128, thereby widening the clip 29. When the pawls 34 slide over the stopper projections 125, the base piece 31 comes into contact with the bearing face 124 (see FIG. 14). Thereafter, the pawls 34 engage with the insides of the stopper projections 125 by means of the elastic recovery force of the base piece 31.

Since the clip 29 engages with the underside of the bottom wall of the holding sleeve 24 when the clip 29 is mounted on the inner connection portion 7, the connector 100 is held in the holding sleeve 24 to be prevented from sliding out of the sleeve 24 by the clip 29.

In this embodiment, the engagement of the pawls 34 with the insides of the stopper projections 125 restrict the leg pieces 33 from deforming in a widening direction, namely, in a direction in which the clip 29 moves away from the inner connection portion 7. In addition, since the elastic recovery force exerted in the base piece 31 biases the pawls 34 in a direction engaging with the stopper projections 125 when the clip 29 is completely mounted on the portion 7, the engaging force of the clip 29 can be further enhanced, thereby surely securing the clip 29 to the portion 7 and eventually fixing the connector 100 in the holding sleeve 24.

Contrary, in the case of removing the connector 100 from the holding sleeve 24, the base piece 31 is pushed onto the flat bearing face 124 so that the pawls 34 are released from the stopper projections 125. Then, the leg pieces 33 are widened and the clip 29 can be removed from the inner connection portion 7. Consequently, the connector 100 can be removed from the holding sleeve 24.

OTHER EMBODIMENTS

The present invention should not be limited to the above embodiments described in the foregoing and drawings. For example, the following alternations should be included in the technical scope of the present invention.

Although the connector 1 is provided with the guide which serves to escape the clip 29 from the holding sleeve 24 in the first embodiment, the guide may be provided on the clip 29.

Although a part (inner connection portion 7) of the connector 100 is exposed from the lower end of the holding sleeve 24 and the clip 29 is mounted on the exposed part in the third embodiment, the holding sleeve 24 may be so long that the connector 100 is not exposed from the sleeve 24 and may be provided in the middle section with the windows as described in the first embodiment. In this case, the clip 29 is mounted on the sleeve 24 before the connector is inserted into the sleeve. For example, the clip 29 may be temporarily mounted on the sleeve 24 so that the leg pieces 33 enter the interior in the sleeve through the windows. Thereafter, when the connector is inserted into the sleeve, the leg pieces are expelled from the windows by the connector. When the connector reaches the regular position in the sleeve, the leg pieces enter the interior again by means of the elastic recovery force, thereby preventing the connector from coming out of the sleeve.

What is claimed is:

1. A connector assembly comprising a connector and a holding sleeve adapted to be mounted on a surface, said connector having an inner portion with an inner end and, remote therefrom, an outer portion;

said inner portion fitted in a hollow small diameter portion of said holding sleeve complementary thereto;

a pair of windows in said small diameter portion and a pair of locking grooves in said inner portion, said windows and said locking grooves being in register with each other and positioned opposite each other;

a spring clip having a generally U-shaped configuration with a pair of resilient legs, each of which extend out from a base and are substantially parallel to each other, one of each of said legs projecting through one of said pair of windows and into one of said pair of grooves, wherein said inner portion is retained in said small diameter portion and whereby said windows, said grooves and said spring clip act to correct misalignment between said connector and said holding sleeve.

2. The connector assembly of claim 1 wherein there is a body between said outer portion and said inner portion, said body being larger in transverse cross section than said inner portion.

3. The connector assembly of claim 2 wherein said inner portion and said body are cylindrical and said body has a diameter greater than that of said inner portion.

4. The connector assembly of claim 3 wherein said holding sleeve carries a large diameter portion which has a larger diameter than said small diameter portion and is complementary to said body.

5. The connector assembly of claim 1 wherein said base of said clip has an arcuate configuration and sand clip has a pair of hook portions each of which is formed by turning a distal end of each leg inwardly.

6. The connector assembly of claim 1 wherein a ramp is provided on said inner end, said ramp sloping radially inwardly in a direction of insertion of said inner portion into said holding sleeve.

* * * * *